United States Patent [19]

Jones

[11] Patent Number: 4,706,577

[45] Date of Patent: Nov. 17, 1987

[54] SAFE DOOR LATCH DEFORMATION ACTUATED INTERLOCK

[75] Inventor: Pamela K. Jones, Emsworth, England

[73] Assignee: International Business Machines Corporation, Armonk, N.Y.

[21] Appl. No.: 67,409

[22] Filed: Jun. 23, 1987

Related U.S. Application Data

[63] Continuation of Ser. No. 855,861, Apr. 24, 1986, abandoned.

[51] Int. Cl.[4] ..... E05G 1/04

[52] U.S. Cl. ..... 109/59 T; 109/42; 70/1.5

[58] Field of Search ..... 70/1.5, 333, 416, 418; 109/59 R, 59 T, 30, 41, 42; 292/210

[56] References Cited

U.S. PATENT DOCUMENTS

| | | | |
|---|---|---|---|
| 262,103 | 8/1882 | Newbury | 70/1.5 |
| 1,857,971 | 5/1932 | Oleschak, Jr. | 70/1.5 |
| 2,209,067 | 7/1940 | Belknap | 70/1.5 |
| 2,534,414 | 12/1950 | Cleave | 292/210 |
| 2,644,708 | 7/1953 | Poole | 292/210 |
| 4,266,488 | 5/1981 | Markham | 70/1.5 |

*Primary Examiner*—Neill Wilson

*Attorney, Agent, or Firm*—Karl O. Hesse

[57] ABSTRACT

A lockable enclosure is disclosed which may be installed at locations accessible to customers for vending merchandise, dispensing money or receiving deposits, and where a potential attacker would have only a limited period of time to break into the enclosure before the police or security personnel would be able to arrive and intervene against the attacker. The latches and latch bolts of the enclosure have apertures or projections which interlock with mating projections or apertures upon deformation of the sheet metal door or the sheet metal walls of the enclosure when an attacker deforms the enclosure sufficiently to cause damage to the lock or latches. Such interlocking prevents retraction of the latches or latch bolts holding the door closed even if the lock mechanism is completely destroyed or removed by force.

11 Claims, 8 Drawing Figures

SAFE DOOR LATCH DEFORMATION ACTUATED INTERLOCK

This is a continuation of co-pending application Ser. No. 855,861, filed on Apr. 24, 1986 and now abandoned.

BACKGROUND OF THE INVENTION

1. Field of the Invention

The invention relates to safe enclosures which may be installed at locations accessible to customers for vending merchandise, dispensing money or receiving deposits. More particularly the invention relates to sheet metal enclosures which upon attack by an unauthorized force impose one or more additional impediments to an attacker who has only a limited period of time to break into the enclosure before the police or security personnel are able to arrive and intervene against the attacker.

2. Prior Art

Safe enclosures are well known in the prior art, ranging from massive vaults to simple key lock tin boxes. Massive vaults are provided to resist prolonged attack by professional safe crackers and therefore are very thick and heavy. They are unsuited for vending machines because of their mass, bulk and cost. The simple sheet metal enclosures of the prior art, an example of which is the trunk of an automobile, primarily functions to keep amateur thieves from gaining access to the contents. With an inwardly directed force on a sheet metal enclosure, using a punch or other sharp instrument, the sheet metal will deform so that the entire lock mechanism will pop out of its opening to give access to the latch mechanism. With the lock removed, it is often a simple matter to rotate the latch mechanism with a screw driver or other tool and open the sheet metal safe in a matter of seconds.

It is known in the art to provide interengaging elements at the periphery of a door to prevent the door or the side wall from being defined sufficiently to allow the latches to disengage and the door to open. An example is shown in U.S. Pat. No. 3,819,228. It is also known to provide pins or other engaging elements to prevent removal of a door by merely removing the hinges as taught in U.S. Pat. No. 3,970,340.

None of these prior art teachings are effective to protect a sheet metal enclosure following destruction or removal of the lock mechanism.

In U.S. Pat. No. 146,782, auxiliary bolts having no connection to the lock are provided to spring out and fasten the door when a trigger plate over the lock is pressed. This teaching adds significant cost to the enclosure and does not take advantage of deformation of the materials from which the enclosure itself is made.

U.S. Pat. No. 262,103 does show a thick safe door which takes advantage of the deformation which can be expected when an explosive charge, calculated to break or displace the lock mechanism, is detonated against the door. In this patent, the rigidity of the door and the bolt assembly are relied upon to hold the catch and door together to prevent opening the door after damage to the lock. Sheet metal is inherently not rigid and the catch of this patent will not reliably hold in an enclosure made of sheet metal.

SUMMARY OF THE INVENTION

It is an advantageous effect of the invention to provide a relatively light, yet secure, sheet metal fabricated safe enclosure which is not so heavy and massive so as to be inappropriate in a public lobby of a store or bank. It can be fastened to the floor to prevent removal of the entire machine and have thin inexpensive walls to reduce the space requirements and floor load supporting requirements yet provide significant resistance to attack. These and other objects of the invention are provided by designing into the latches and latch bolts, apertures or projections which interlock with mating projections or aperture respectively upon deformation of the sheet metal door or the sheet metal walls of the enclosure sufficient to cause damage to the lock or latches. Such interlocking prevents retraction of the latches or latch bolts holding the door closed even if the lock mechanism is completely destroyed or removed by force.

DESCRIPTION OF THE PREFERRED EMBODIMENT OF THE INVENTION

Figure 1:
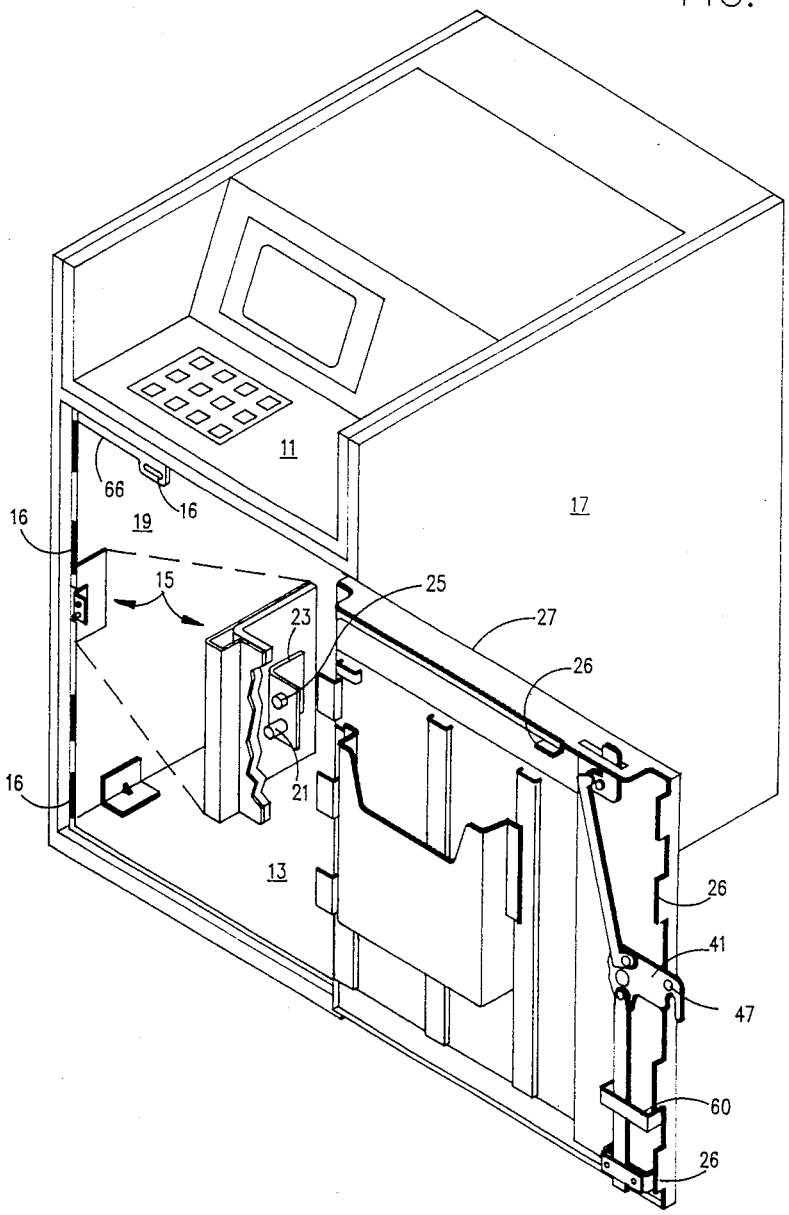
FIG. 1 shows an example enclosure in which the invention has been applied.
Figure 2:
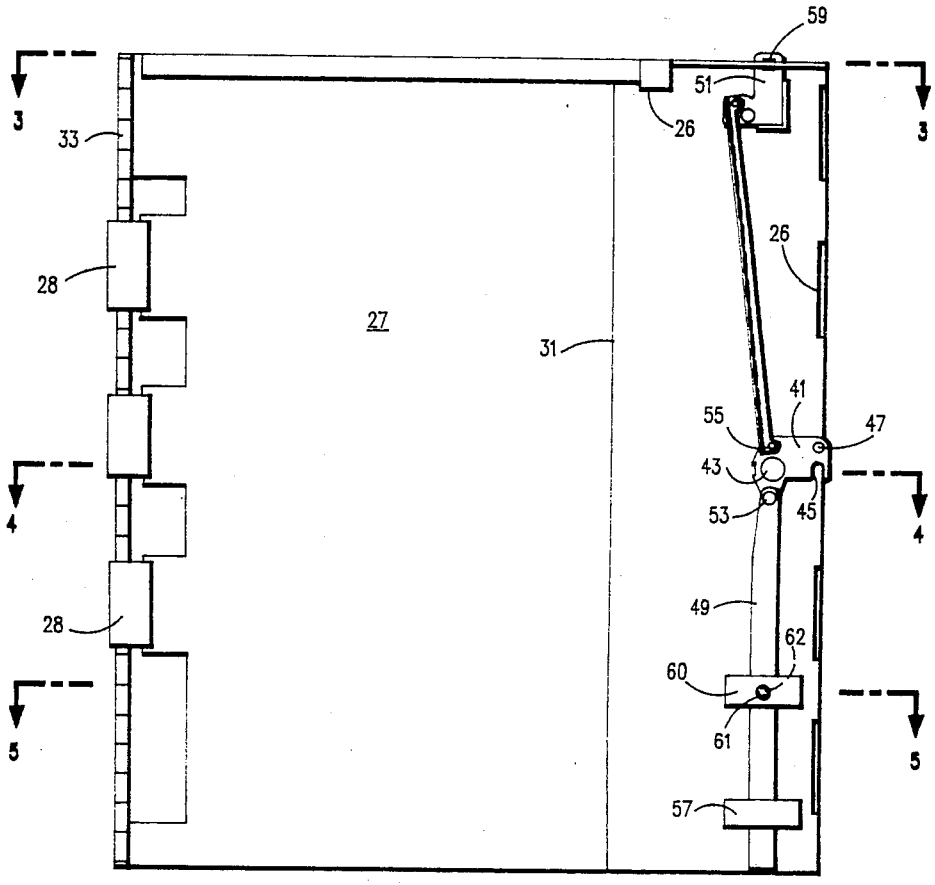
FIG. 2 shows an inside view of a door having latches according to the teachings of this invention.

FIG. 1 shows a sheet metal automatic teller machine enclosure incorporating the invention. The enclosure has a top 11, a bottom 13, a rear wall, and two side walls 17 and 19. Hinges are attached to the door jamb at the vertical front edge of wall 17 in the usual manner for mounting an access door 27 to close the front of the enclosure. Wall 19 has a catch assembly 15 shown in greater detail in the expanded inset view. Catch assembly 15 includes a catch pin 21 mounted to angle plate 23 for engagement with a latch 41 mounted in the door which is shown in FIG. 2. In addition to catch pin 21, interlock pin 25 is provided which interlocks with a mating interlock aperture 47 in latch 41 to capture the latch in the latched position if the sheet metal enclosure is subjected to deformation during an attack.

It has been found that the latch is more advantageously made of a hardened stock which is not easily welded. For this reason, forming an aperture or other mating interlock surface in the latch before hardening results in a stronger assembly.

Access door 27 has a plurality of tabs 26 which engage slots 16 when the door is closed to make it difficult to pry the door 27 away from wall 19. Such tabs are well known in the art for preventing a door from opening by deformation of a side wall and cooperate with, but form no part of, the invention.

Referring now to FIG. 2, the inside of the access door 27 is shown. The outside of the door 27 is a simple planar surface having a key lock for controlling the latches to open the door. The door 27 is made of sheet metal having a number of reinforcing sheet metal strips 29 and 31.

Figure 4:
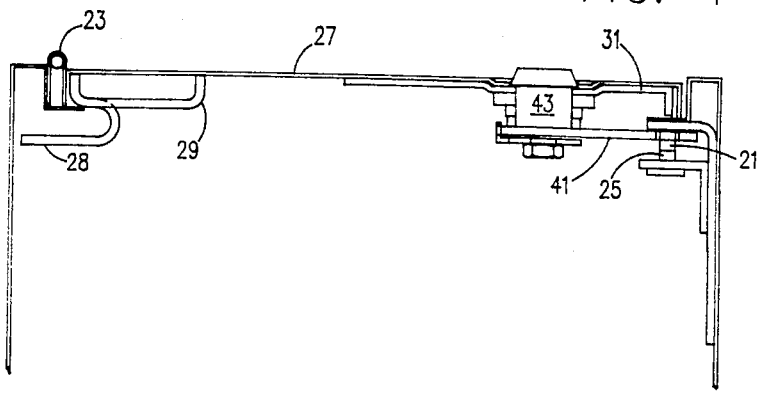
FIG. 4 shows a cross section of a latch and lock mechanism in accordance with the invention.
Figure 3:
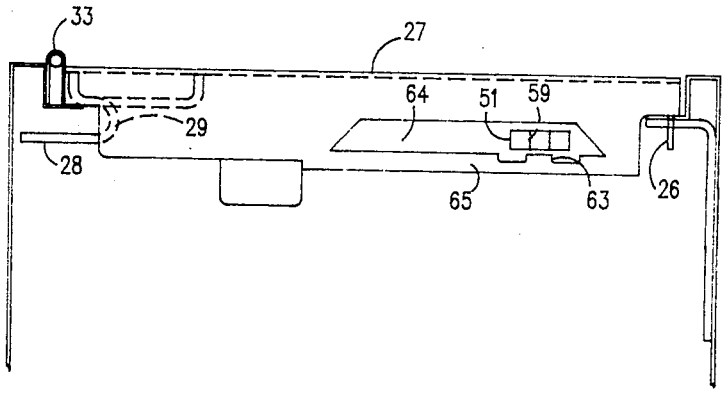
FIG. 3 shows a top view of the door.
Figure 5:
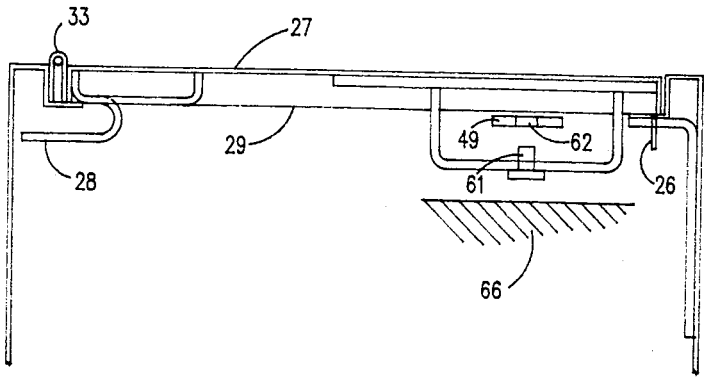
FIG. 5 shows a cross section of a bolt type latch in accordance with the invention.

Mounted at the left vertical edge of door 27 as shown in FIG. 2 is a hinge 33. Tabs 28 are formed as part of sheet metal reinforcing strip 29, which is also shown in FIGS. 3, 4, and 5. Tabs 28 extend behind the front edge of wall 17. Tabs 28 prevent removal of the door 27 by cutting the hinge 33 from either the door or the wall.

In the center of the right edge of the door is a latch 41 operated by a lock mechanism 43. Latch 41 is shown in the latched position where catch 45 engages catch pin 21 in the sidewall of the enclosure. Latch 41 also has an aperture 47 which engages interlock pin 25 only upon deformation of the wall or door of the enclosure. Lock 43 is adapted to rotate latch 41 counterclockwise approximately 90 degrees to unlatch door 27. When latch 41 is rotated 90 degrees, bolt 49 and latch 51 are also moved by virtue of their being fastened to latch 41 by pins 53 and 55 respectively. Bolt 49 passes downward inside of the door through bracket 60 and through guide plate 57 which holds bolt 49 against the inside of the door. Bolt 49, supported by plate 57, catches behind the front bottom edge of the door jamb of the enclosure and holds the door closed when the bolt has been extended with the door closed. When the door is closed and bolt 59 is fully extended, pin 61 on bracket 60 is juxtaposed to aperture 62 in bolt 49. In the event that an attack is made upon the lock area of the door, the door will be deformed inward in the vicinity of the lock, allowing the top of bolt 49 to move inward. Such motion will cause aperture 62 to engage pin 61 and thereafter prevent retraction of bolt 49 even if lock 43 is ultimately destroyed and latch 41 could otherwise be rotated. In like manner latch 51 has an aperture 59 which is engaged by the edge of the door when the door is deformed as shown more clearly in FIG. 3.

Referring then to FIG. 3, latch 51 is shown extending through opening 64. Latch 51 has an aperture 59 which is engagable by interlock projection 63 which is part of the top edge of the door. If pressure is placed by means of a hammer or otherwise on the outside upper surface of the door, web 65 having projection 63 is deformed toward latch 51 by virtue of it being supported by member 66 fastened to the top of the enclosure as shown in FIG. 1. When web 65 is deformed, projection 63 engages aperture 59 in latch 51 to prevent latch 51 from rotating out of opening 64 so as to release the top of the door from its latched position.

FIG. 3 also more clearly shows reinforcing sheet metal strip 29 to which hinge 33 is fastened. Tabs 28 extend behind hinge 33 when door 27 is closed to prevent access by removing hinge 33.

FIG. 4 shows a section through the door at the lock and more clearly show the operation and configuration of latch 41 and its relationship to interlock pin 25. From FIG. 4 it can be more clearly seen that when a hammer or other tool is used to attempt to open or destroy lock 43, the front face of the door in the vicinity of lock 43 will deform inward permitting latch 41 to interlock with pin 47 and thereafter prevent rotation of latch 41 even if lock 43 is ultimately destroyed.

Referring now to FIG. 5, the door near the bottom as shown by section lines 5—5 in FIG. 2 is presented in cross section. FIG. 5 clearly shows bolt 49 having an aperture 62 which is captured on pin 61 when either the front of the door is pushed inward or alternately when the portion of the door in the lock area is pushed inward causing bolt 49 to assume an angle from the bottom of the door upward. Since pin 61 is mounted some distance from the bottom of the door, bolt 49 will move inward and be captured on pin 61. Backing support 66 may be some heavy component such as a transformer or a frame member which resists inward motion of bracket 60 if force is applied to the outside of door 27. Abnormally high force as may occur when someone is attempting to force open door 27 will cause bracket 60 to deform toward latch 49. FIG. 5 also shows the tabs 26 in the door at the right, and another, 28 shown at the hinge. These engaging tabs are well known in the prior art and are useful to provide improved attack resistance to the sheet metal enclosure but form no part of applicants invention.

Figure 6:
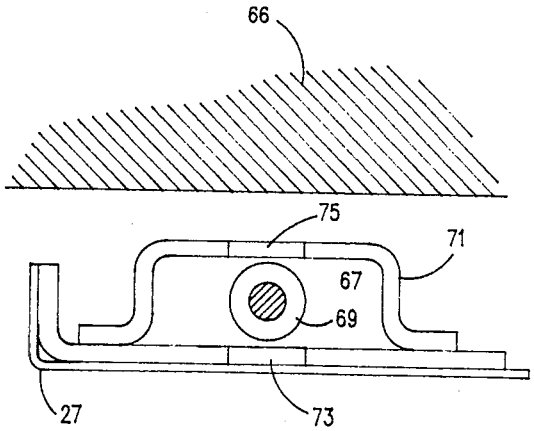
FIG. 6 shows an alternate interlock embodiment.
Figure 7:
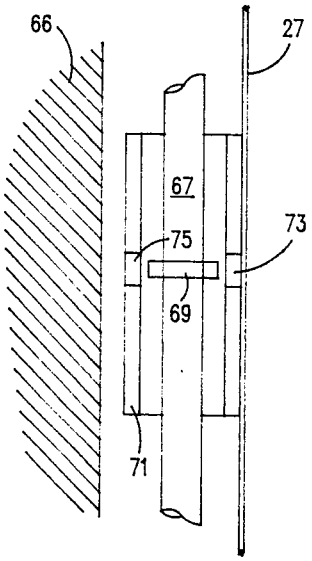
FIG. 7 show a side view of the alternate embodiment.
Figure 8:
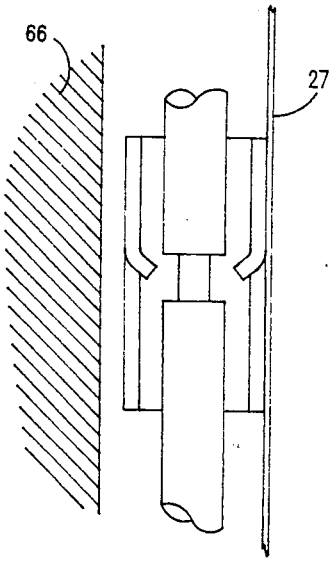
FIG. 8 shows still another embodiment of a latch interlock according to the invention.

Referring now to FIG. 6, an alternate embodiment for the latch bolt 57 is shown as a bolt 67 having a projection 69. The interlock supporting bracket 71 is provided with apertures 73 and 75 to engage the mating surface 69 and prevent the door bolt from being retracted if the door is deformed from the front or the entire door is pushed inward. FIG. 7 shows the same bolt 67 and bracket 71 in vertical position. As can be better seen in FIG. 7, if force is applied to the door 27 from the outside, bracket 71 will deform and interlock latch bolt 67 to prevent retraction. FIG. 8 shows an alternate embodiment of bolt 67 wherein the bolt carries the aperture and the interlock support carries the projections.

It will be recognized by those skilled in the art of enclosure design that other deformable materials such as plastics may be substituted for sheet metal to achieve the advantages of the invention. These and other variations in the implementation of the invention will suggest themselves to those skilled in the art without departing from the spirit and scope of the invention as measured by the following claims.

What is claimed is:

1. An enclosure having sheet metal walls and a lockable sheet metal access door, said door having a latch which engages a wall of said enclosure to prevent opening said door, said latch being mounted for rotation on a lock mechanism for opening said door, the improvement comprising: an interlock in said enclosure at an edge of said door;

said latch having a mating interlock at its wall engaging end which is engaged by said interlock to prevent retraction of said latch when said lock mechanism and said latch mounted thereon are moved inwardly during an attack upon said enclosure.

2. The enclosure of claim 1 wherein said interlock is a projection mounted in said enclosure so as not to interfere with movement of said latch prior to inward movement of said lock mechanism and said latch mounted thereon; and wherein said mating interlock is a surface of said latch which interferes with motion of said latch after inward movement of said lock mechanism and said latch mounted thereon.

3. The enclosure of claim 2 wherein said surface of said latch is an aperture in said latch.

4. An enclosure having sheet metal walls and a lockable sheet metal access door, said door having at least one latch which engages a wall of said enclosure to prevent opening said door, said latch being retractable by a lock mechanism for opening said door, the improvement comprising:

an interlock in said enclosure at an edge of said door;

said latch having a mating interlock at its wall engaging end which is engaged by said interlock to prevent retraction of said latch when said sheet metal is deformed near said interlock during an attack upon said enclosure;

wherein said interlock is a projection on a bracket mounted to said wall of said enclosure so as not to interfere with movement of said latch prior to deformation of said enclosure; and wherein said mating interlock is an aperture in said latch which interferes with motion of said latch after deformation of said enclosure at said edge of said door.

5. The enclosure of claim 4 wherein said latch rotates to engage a catch mounted to said wall of said enclosure, said latch being mounted for rotation on said lock mechanism, said latch moving to engage said aperture onto said projection when said door is deformed in the vicinity of said lock.

6. An enclosure having sheet metal walls and a lockable sheet metal access door, said door having at least one latch which engages a wall of said enclosure to prevent opening said door, said latch being retractable by a lock mechanism for opening said door, the improvement comprising:

an interlock in the form of a projection on a bracket mounted to said door between said wall and said lock, said bracket surrounding said latch;

bracket support means mounted separate from said door in said enclosure for contacting and supporting said bracket against inward movement when said door is forced inwardly, said bracket thereby being deformed so as to cause said projection on said bracket to interfere with said latch and prevent retraction of said latch after deformation of said bracket.

7. An enclosure having sheet metal walls and a lockable sheet metal access door, said door having at least one latch which engages a wall of said enclosure to prevent opening said door, said latch being retractable by a lock mechanism for opening said door, the improvement comprising:

an interlock in said enclosure at an edge of said door;

said latch having a mating interlock at its wall engaging end which is engaged by said interlock to prevent retraction of said latch when said sheet metal is deformed near said interlock during an attack upon said enclosure;

wherein said interlock is a projection formed into a web spanning an opening in an edge of said door, said latch operating through said opening;

support means, mounted to a wall adjacent said opening, preventing substantial inward motion of said web in response to inward force on the outside of said door;

said mating interlock of said latch interfering with said projection to prevent retraction of said latch after deformation of said web at least partially closing said opening by said inward force on said outside of said door.

8. The enclosure of claim 7 wherein said opening is in a top edge of said door and said latch is mounted for rotary retraction into and extension out through said opening, the center of gravity of said latch being lower when said latch is rotated out through said opening so that damage to a latch operating mechanism will not permit the latch to fall open due to gravity and wherein said mating interlock is an aperture in said latch which interferes with said projection to prevent retraction of said latch after deformation of said enclosure.

9. An enclosure having sheet metal walls and a lockable sheet metal access door, said door having at least one latch which engages a wall of said enclosure to prevent opening said door, said latch being retractable by a lock mechanism for opening said door, the improvement comprising:

an interlock in said enclosure at an edge of said door;

said latch having a mating interlock at its wall engaging end which is engaged by said interlock to prevent retraction of said latch when said sheet metal is deformed near said interlock during an attack upon said enclosure;

wherein said interlock is a pair of projections in said enclosure and wherein said mating interlock is an aperture in said latch which interferes with one of said projections to prevent retraction of said latch after deformation of said enclosure.

10. The enclosure of claim 9 wherein a first projection is mounted on a bracket adjacent said latch on a side of said latch away from said door and between an edge of said door and said lock, a second projection is mounted on said door adjacent said latch said mating interlock on said latch interfering with said first projection to prevent retraction of said latch when said door is deformed inwardly in the area of said lock and said mating interlock on said latch interfering with said second projection to prevent retraction of said latch when said door is deformed inwardly in the vicinity of said second interlock.

11. A door having a locking mechanism including a lock and a movable latch mounted thereon for rotation between a locked position in engagement with a door jamb and an unlatched position out of engagement said said door jamb, the improvement comprising:

means carried on said door jamb and positioned adjacent said latch in its latched position for interlocking with said latch when said lock is moved inwardly.

* * * * *

UNITED STATES PATENT AND TRADEMARK OFFICE

CERTIFICATE OF CORRECTION

PATENT NO. : 4,706,577

DATED : November 17, 1987

INVENTOR(S) : Pamela K. Jones

It is certified that error appears in the above-identified patent and that said Letters Patent are hereby corrected as shown below:

Col. 1, line 40: Change --defined-- to deformed

Col. 3, line 50: Change --show-- to shows

In Claim 11, col. 6, lines 46 and 47: Change --said said-- to with said

Signed and Sealed this

Seventeenth Day of May, 1988

*Attest:*

*Attesting Officer*

DONALD J. QUIGG

*Commissioner of Patents and Trademarks*